US005706686A

United States Patent [19]

Babbitt et al.

[11] Patent Number: 5,706,686

[45] Date of Patent: Jan. 13, 1998

[54] METHOD AND APPARATUS FOR INSIDE CAN BASE REFORMING

[75] Inventors: Terry Babbitt, Lynchburg; Alexander A. Henzel, Forest, both of Va.; Kevin Reed Jentzsch, Arvada, Colo.

[73] Assignee: Delaware Capital Formation, Inc., Wilmington, Del.

[21] Appl. No.: 610,655

[22] Filed: Mar. 4, 1996

Related U.S. Application Data

[63] Continuation-in-part of Ser. No. 590,335, Jan. 23, 1996, which is a continuation of Ser. No. 436,819, May 8, 1995, abandoned, which is a continuation-in-part of Ser. No. 268,812, Jun. 30, 1994, abandoned, which is a continuation-in-part of Ser. No. 189,241, Jan. 31, 1994, Pat. No. 5,433,098.

[51] Int. Cl.[6] ..... B21D 51/26

[52] U.S. Cl. ..... 72/117; 72/123

[58] Field of Search ..... 72/117, 122, 123, 72/353.4, 393

[56] References Cited

U.S. PATENT DOCUMENTS

| | | | |
|---|---|---|---|
| 2,612,204 | 9/1952 | Rickhoff et al. | 72/123 |
| 5,222,385 | 6/1993 | Halasz et al. | 72/117 |
| 5,355,709 | 10/1994 | Bauder et al. | 72/393 |
| 5,433,098 | 7/1995 | Bowlin et al. | 72/117 |

FOREIGN PATENT DOCUMENTS

| | | | |
|---|---|---|---|
| 63-299821 | 12/1988 | Japan | 72/117 |

*Primary Examiner*—Lowell A. Larson
*Attorney, Agent, or Firm*—Reid & Priest LLP

[57] ABSTRACT

An apparatus and method is shown for reforming the bottom of a container. The container is supported during processing by a container holder. A number of tooling rams each have a reforming roller supported by a pivot roller shaft that is in turn connectedly pinned to one end of a pivot arm. The opposite end of the pivot arm is connectedly pinned to an eccentric lug on a pivot base that is connected to a tooling drive shaft. The reforming roller is restrained axially by roller guide disks mounted to the tooling rams and is driven by the pivot arm such that the reforming roller travels along a circular orbital path of varying diameter in a plane perpendicular to the central axis of the pivot roller shaft and having a center of curvature position coextensive with the container axis. The tooling drive shaft is supported rotatably in and moved axially with a tooling ram that moves axially toward or away from the container. Axial and rotational movement of the pivot arm is converted to radial and rotational movement of the reforming roller as a result of the pinned connections between the pivot arm and the pivot base and the pivot arm and the pivot roller shaft, and as a result of the restraint on axial movement of the reforming roller. The container holder supports the container during reforming either on portions of the outer periphery of the container that are axially offset from a plane defined by the circular orbital path traveled by the reforming roller, or only along an annular arcuate portion of an annular flange-like ridge around the base of the container.

2 Claims, 9 Drawing Sheets

METHOD AND APPARATUS FOR INSIDE CAN BASE REFORMING

BACKGROUND OF THE INVENTION

This application is a CIP of U.S. patent application Ser. No. 08/590,335, filed Jan. 23, 1996, which was a Continuation of U.S. patent application Ser. No. 08/436,819, filed May 8, 1995, now abandoned, which was a CIP of U.S. patent application Ser. No. 08/268,812, filed Jun. 30, 1994, now abandoned which was a CIP of U.S. patent application Ser. No. 08/189,241, filed Jan. 31, 1994, now U.S. Pat. No. 5,433,098, issued Jul. 18, 1995.

FIELD OF THE INVENTION

The present invention relates to a method and apparatus for forming an improved, reformed container bottom, with a result that the entire container is strengthened. Typically, this method and apparatus is used for reforming the bottoms of containers which have been formed of aluminum or other metal.

RELATED ART

U.S. Pat. No. 5,222,385, which is assigned to American National Can Company, Inc., (hereinafter referred to as the "ANC" patent) describes a method and apparatus for reforming the bottoms of drawn and ironed beverage containers. As stated in the ANC patent, which is herein incorporated by reference, the reforming of the can bottom results in an increase in the strength of the cans above that of prior art cans.

The apparatus of the ANC patent includes a jig 48 for supporting a container along the entire extent of an outer annular wall 26 of the container extending downwardly from the generally cylindrical side wall of the container, and a reforming roller that is brought into engagement with a substantially vertical wall 34 joining a central domed portion of the container to a convex U-shaped portion that defines a flange-like ridge on the bottom of the container. The reforming roller is brought into engagement with the substantially vertical wall and rotates along an arcuate path that is in radial alignment with the mating surface between the jig and the outer annular wall 26 of the container. This apparatus requires the provision of spring biasing means to retract the rollers after their engagement with the container. Furthermore, separate and distinct means for moving the rollers in a radially outward direction to contact the can surface at the substantially vertical wall, and for driving the reforming rollers about the arcuate path during the reforming process, are required.

SUMMARY OF THE INVENTION

The primary object of the present invention is to provide a new and improved method and apparatus for reforming the bottom of a container. The present invention provides an improved version of a can bottom reformer that eliminates the need for a spring biasing means; that simplifies the design by providing a single means for driving the reforming roller along an arcuate path and for actuating the reforming roller radially outwardly; that reduces variances in the dimensions of the reformed base of a container; and that eliminates the need for a large number of different jigs having different shapes to conform to containers having various lower end configurations.

Can manufacturers are constantly striving to increase productivity by increasing the number of cans that are processed per unit of time—approaching 3600 cans per minute in some cases. Such high speed processing, in combination with a requirement to hold tolerances on can base dimensions to plus or minus 0.002 inch, necessitates a means for precisely controlling the movement of the reforming roller into and out of contact with the can base. The actuating means of the present invention provides such a means.

An embodiment of the present invention includes a plurality of substantially identical processing stations. Each of these processing stations includes two facing turrets, namely, a tool turret and a feed turret. The tool turret has a plurality of circumferentially spaced tooling rams. In a first embodiment, each tooling ram has a rotating cam mounting block that supports two radially extending skewed positioner cams and two parallel guide blocks, which are in turn engaged with slots in a roller mounting block that supports a reforming roller. The other of the facing turrets has a plurality of circumferentially spaced can push rams, each of which is in alignment with a respective tooling ram. A main starwheel is fixed between the two facing turrets and rotates in synchronism with them. Additionally, in-feed and outflow starwheels are provided radially outwardly from the main starwheel and provide means for quickly and effectively transferring can bodies to and from the main starwheel between the two facing turrets. Details of a method and apparatus for transferring can bodies to and from the plurality of identical processing stations are described in pending U.S. patent application Ser. No. 08/069,006, (hereinafter referred to as the "Bowlin et al." application) filed May 28, 1993, which is incorporated herein by reference, since similar means are used in the present invention.

Each can is transported into a horizontal working position aligned with a tooling ram by a starwheel. A can push ram is then actuated by a push ram drive cam to engage the open or "top" end of the aligned can to move it axially toward the tooling ram by pushing the can axially toward the reforming roller on the tooling ram. When the can push ram has reached its full stroke, the can, which is still on the starwheel, is in work position to be reformed.

In one embodiment of the present invention, a can holder captures the can around the outer diameter of the cylindrical side wall of the can near the bottom of the can, in addition to supporting the can along the convex U-shaped ridge around the bottom of the can.

In a preferred embodiment of the present invention, the can holder comprises an annular ring having an axial end surface facing toward the can bottom and provided with an annular concave groove that mates with the convex U-shaped ridge. In the preferred embodiment, the can holder does not extend beyond the convex U-shaped ridge around the bottom of the can, and therefore does not provide any support for the can along the outer annular wall of the can that joins the outer cylindrical side wall of the can to the convex U-shaped ridge. This embodiment provides significant advantages over the jig used to support a can in the ANC patent. Because the can holder only contacts the can along an annular arcuate portion of the convex U-shaped ridge at the bottom of the can, there is no need to change the can holder to support cans having different annular wall configurations.

The cylindrical side wall of the can is joined by an annular arcuate portion to the outer periphery of the convex U-shaped portion of the can that defines the flange-like ridge on the bottom of the can. A wall substantially parallel to the central axis of the can (hereinafter referred to as a substantially longitudinal wall) joins the inner periphery of the convex U-shaped portion of the can to the central domed portion of the can. The reforming roller moves in a radially outward fashion, contacting said substantially longitudinal wall along an arcuate path at a fixed axial distance from the bottommost edge of the convex U-shaped portion of the can.

In the first embodiment, the reforming roller is moved radially as well as in an orbit about the central axis of the can as a result of axial and rotary movement of a cam mounting block attached to the tooling ram. In a second, preferred embodiment, the reforming roller is moved radially as well as in an orbit about the central axis of the can as a result of axial and rotary movement of a pivot arm that is pivotally attached to the tooling ram and to a pivot roller shaft rotatably supporting the reforming roller.

In one embodiment of the present invention the can holder supports the can along part of the annular arcuate portion joining the cylindrical side wall of the can to the outer periphery of the convex U-shaped portion, and along the bottommost edge of the can. However, the can holder does not contact the can in an annular region of the outer periphery of the convex, U-shaped portion that is in radial alignment with the arcuate path traveled by the reforming roller along the substantially longitudinal wall connected to the inner periphery of the convex U-shaped portion.

As discussed above, the preferred embodiment of the present invention includes a can holder that supports the can along an annular arcuate portion of the convex U-shaped ridge along the bottommost edge of the can. In the preferred embodiment, the can is entirely unsupported in the region of the can that is in substantially radial alignment with the arcuate path traveled by the reforming roller. More particularly, the can holder does not contact the can along any portion of the annular arcuate portion joining the cylindrical side wall of the can to the outer periphery of the convex U-shaped ridge around the bottom of the can.

The present invention includes an apparatus for reforming the base of a cylindrical container having a longitudinal axis, and a substantially longitudinal wall concentric with the longitudinal axis and extending from the base of the container to join a center domed portion of the base to a convex U-shaped ridge on the base. The apparatus according to the present invention includes means for supporting the container; a reforming roller; and a single actuating means for driving the reforming roller to orbit the longitudinal axis of the container, while moving the roller in a radially outward direction relative to the longitudinal axis, thereby bringing the roller gradually into contact with the substantially longitudinal wall of the container while traversing and reforming the substantially longitudinal wall.

The apparatus also includes means for moving the single actuating means in a direction along an axis coinciding with the longitudinal axis of the container, and means for rotating the single actuating means about the same axis. The reforming roller is rotatably supported by mounting means, with the mounting means being supported on the single actuating means. In the first embodiment according to the present invention, the mounting means for the reforming roller is free to move axially and radially relative to the single actuating means, hence having three degrees of linear freedom relative to the single actuating means. In a second, preferred embodiment according to the present invention, the mounting means for the reforming roller is pinned to the single actuating means, hence having only one degree of rotational freedom relative to the single actuating means.

Thus, the first embodiment of the present invention includes each tooling ram having an inside base reforming roller. A roller mounting block is provided for supporting the reforming roller to travel along a circular orbital path of varying diameter in a plane perpendicular to the can central axis and having a center of curvature positioned coextensive with the can central axis. Guide cams that ride along cam surfaces formed in slots in the roller mounting block are supported by a cam mounting block. A tooling drive shaft is connected to the cam mounting block and rotates the cam mounting block about its axis coextensive with the can axis. The tooling drive shaft is supported rotatably in and moved axially with a tooling drive ram assembly that moves axially along the central axis toward or away from the can.

The preferred embodiment of the present invention includes each tooling ram having an inside base reforming roller, a pivot roller shaft rotatably supporting the roller on a roller bearing interface, a pivot arm that is pinned at one end to the pivot roller shaft and pinned at the opposite end to a pivot base, with the pivot base being fixedly attached to the tooling drive shaft and the tooling drive shaft being supported rotatably in and moved axially with a tooling drive ram assembly that moves axially along the central axis toward or away from the can.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
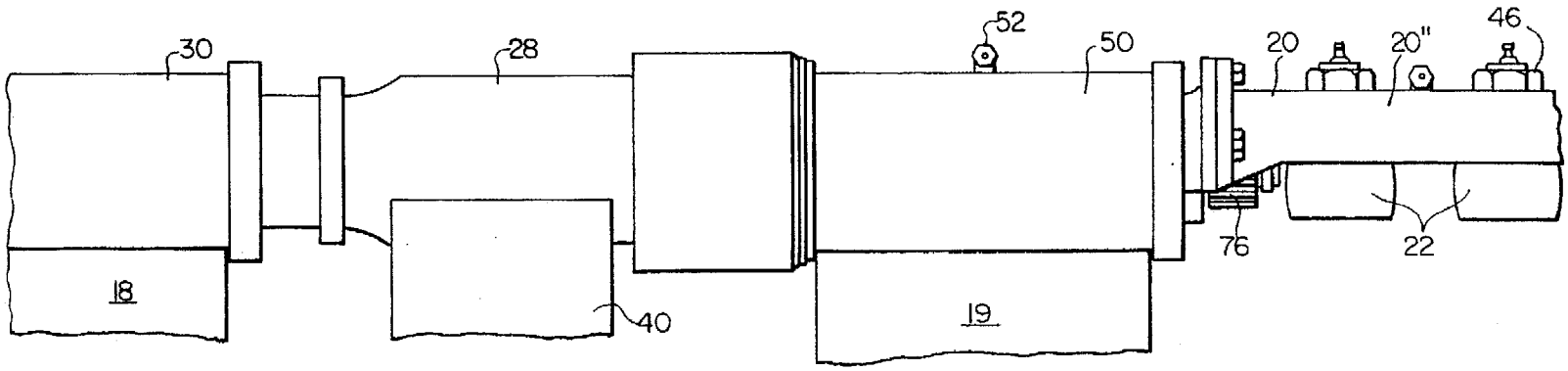
FIG. 1 illustrates a fragmentary front elevation view of the uppermost one of the processing stations of the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Figure 2:
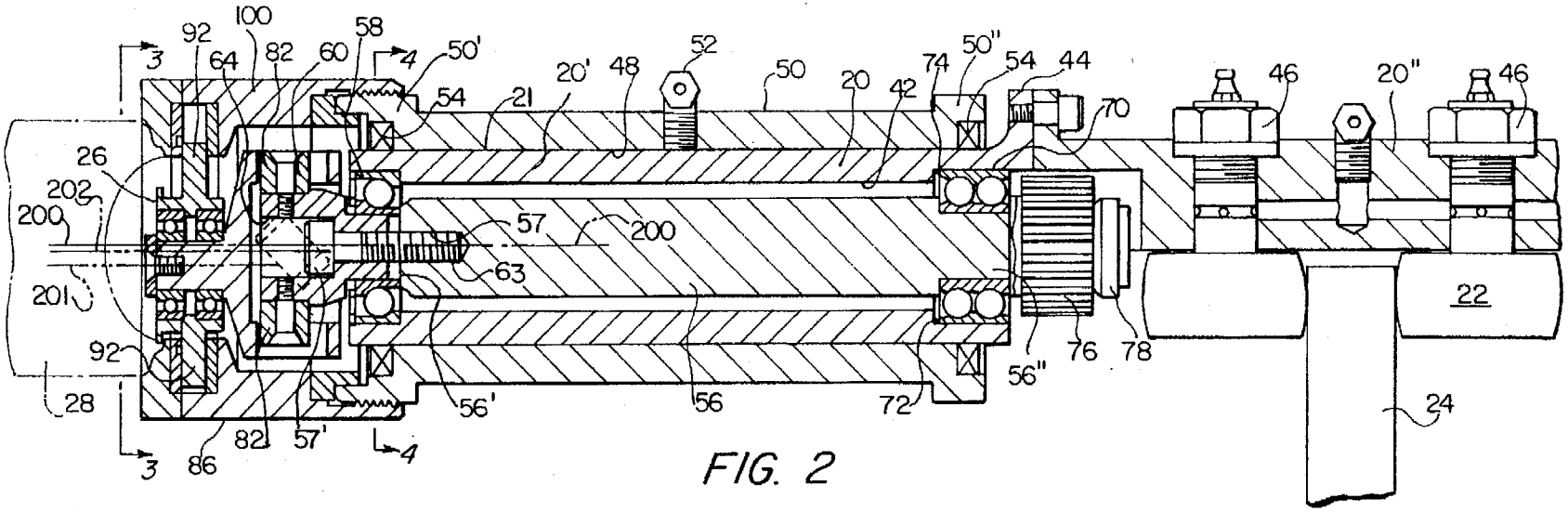
FIG. 2 is a vertical longitudinal cross-sectional view of a first embodiment of the tooling ram of FIG. 1.
Figure 3:
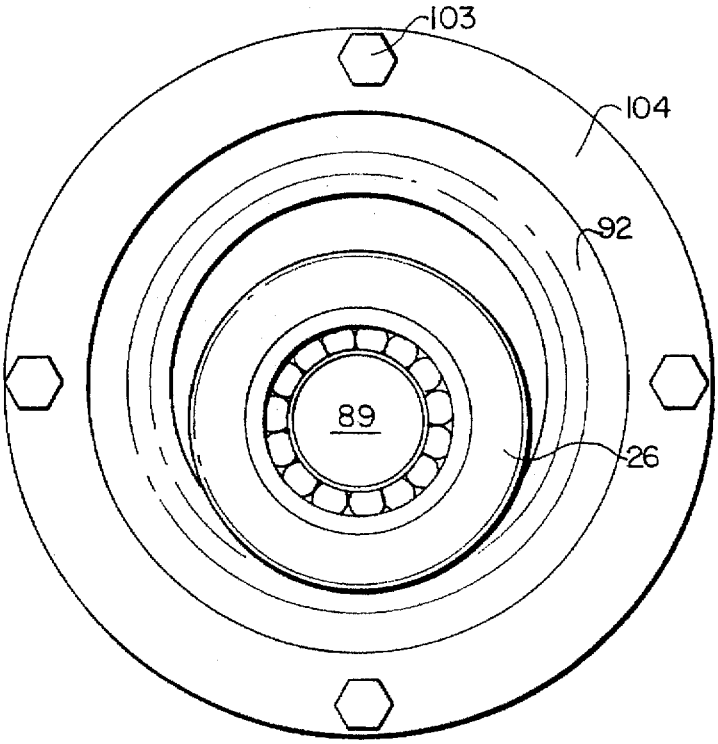
FIG. 3 is an end view of the tooling ram taken along line 3—3 of FIG. 2.

FIG. 1 shows a portion of one of the plurality of identical processing stations that constitutes the present invention. A tool drive ram assembly 20 is shown activated by reactive engagement of cam followers 22 with a fixed cam 24 (FIG. 9) so that a reforming roller 26 is contacting the inner periphery of the annular rim at the bottom of a can 28 (as shown in FIG. 2). Can 28 is held in position between the tool drive ram assembly 20 and a can push ram 30 by a conventional starwheel 40 which can optionally be a vacuum starwheel if desired. A fixed cam 31 provides the small amount of reciprocation required by push ram 30 for positioning the can bottom end for working and for permitting subsequent discharge of the can from starwheel 40.

Figure 10:
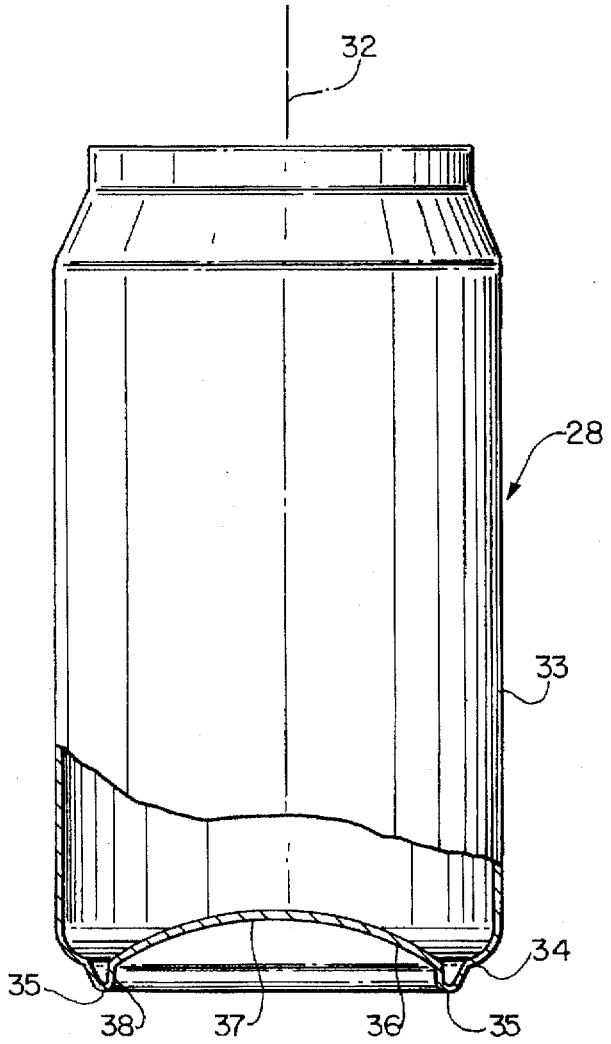
FIG. 10 is an elevation view partially in section of a container which is suitable for treatment by the process and apparatus of the invention.
Figure 11:
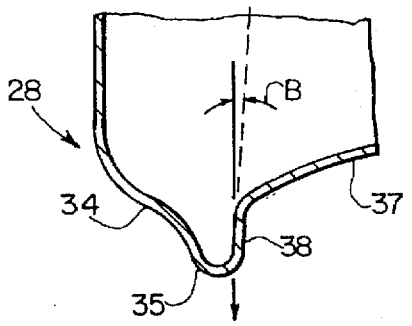
FIG. 11 is an enlarged view of the lower left hand corner of the container of FIG. 10, prior to reforming.
Figure 12:
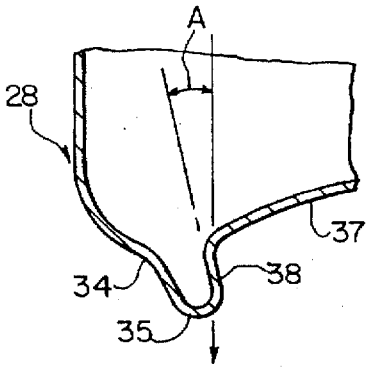
FIG. 12 is an enlarged view of the lower left hand corner of the container of FIG. 10, after reforming.

As described in the ANC patent, and shown in FIGS. 10–12, a typical can to be worked 28 is symmetrical about a longitudinal axis 32. A generally cylindrical side wall 33 parallel with this longitudinal axis forms the panel on which graphics may be printed. An outer annular, arcuate wall 34 forms a transitional portion between this side wall 33 and a convex, U-shaped portion 35 that defines a flange-like ridge at the base of can 28. Can 28 also includes a preformed bottom wall 36 including a center domed portion 37. An annular, substantially longitudinal wall 38 joins domed portion 37 to convex U-shaped portion 35. This substantially longitudinal wall has a positive angle B sloping towards vertical axis 32 before reforming—as shown in FIG. 11. After the completion of the reforming operation that is described in detail below, substantially longitudinal wall 38 has a negative angle A sloping away from vertical axis 32.

The preferred embodiment of the invention employs a plurality of tool drive ram assemblies 20 each of which is supported for rotation on radial supports 18 and 19 that make up the turret which is radially mounted on a main support shaft 23, which is supported for driven rotation on the main frame 25 of the apparatus in the manner of the main shaft of the Bowlin et al. application. Each tool drive ram assembly 20 has a first end 20' and a second end 20" as shown in FIG. 2. First end 20' of tool drive ram assembly 20 is substantially cylindrical in shape and has a central axis 200 and a central axial bore 42 concentric to axis 200 passing therethrough. Ram assembly first end 20' is connected to ram assembly second end 20" by an intermediate connecting portion 44.

Cam followers 22 are secured to ram assembly second end 20" by cam follower retainer nuts 46. Cam followers 22 move along the surface of fixed cam 24 (shown in FIG. 9) as the tooling ram turret is rotated about its center support means. Movement of cam followers 22 along this cam surface causes tool drive ram assembly 20 to reciprocate along central axis 200 concentric to axial bore 42. This reciprocation moves ram assembly first end 20' toward and away from starwheel 40 and a can 28 supported thereon.

End 20' of tool drive ram assembly 20 is concentrically and slidably received within an axial bore 48 in a slide bushing 50 supported on radial support 19 as shown in FIGS. 1 and 2. Slide bushing 50 is also substantially cylindrical in shape and has a first end 50' and a second end 50". The outer cylindrical periphery 21 of tool drive ram assembly first end 20' matingly fits closely to the inner surface of bore 48 of slide bushing 50. A smooth fit between slide bushing 50 and the tool drive ram assembly 20 is ensured by the presence of grease applied to their mating surfaces through grease fitting 52, and sealed against escaping from the space between their mating surfaces by oil seals 54 provided at each end of slide bushing 50.

Figure 4:
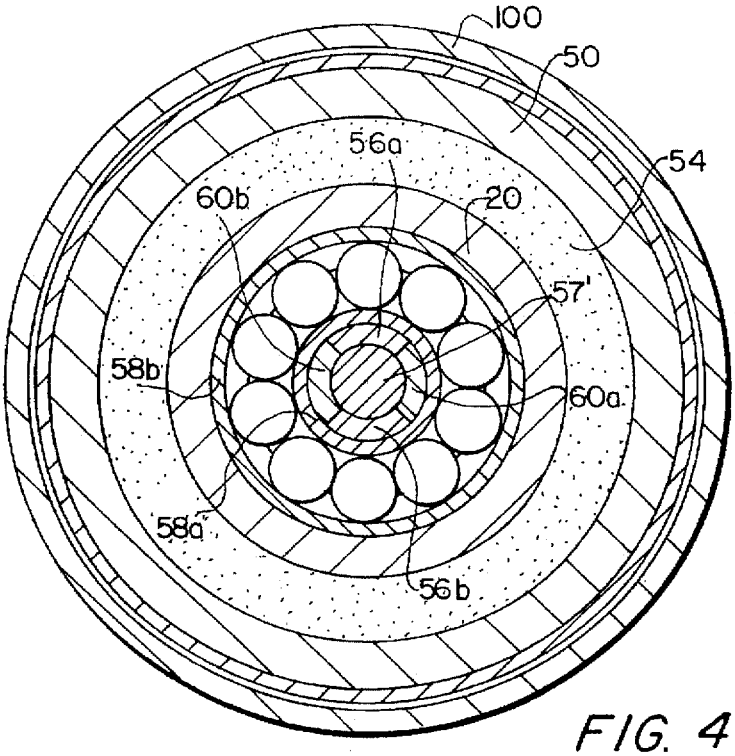
FIG. 4 is a transverse section taken along lines 4—4 of FIG. 2 through the ball bearing assembly supporting one end of the tooling drive shaft.
Figure 5:
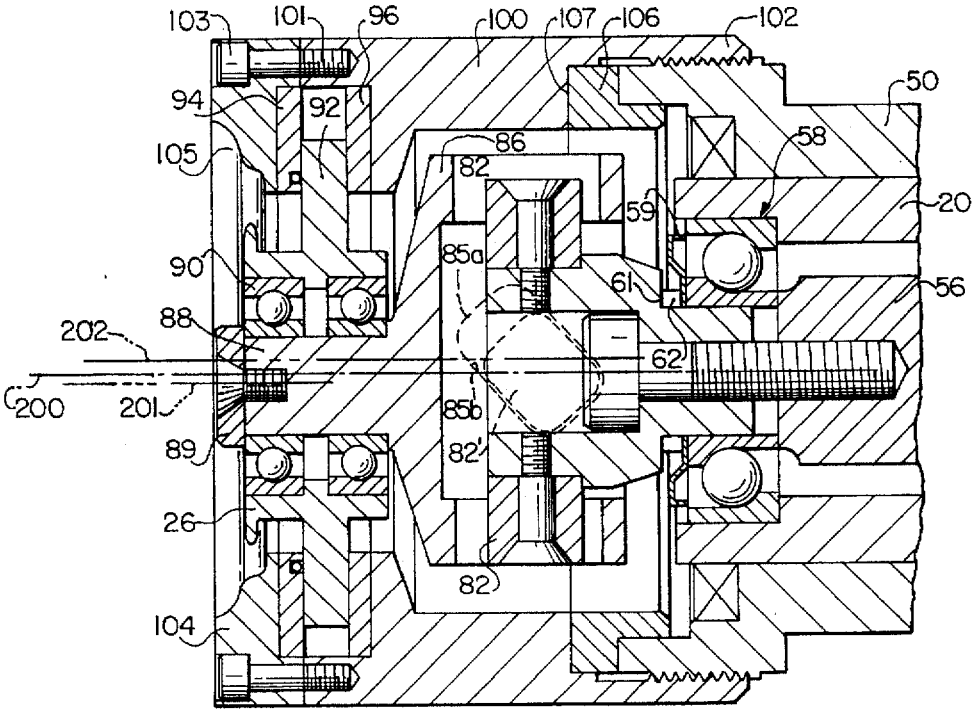
FIG. 5 is a cross-sectional view showing the reforming roller in its fully retracted position.

As shown in FIG. 2, a tooling drive shaft 56 is concentrically mounted relative to axis 200 for rotation within ram assembly first end 20'. Tooling drive shaft 56 is located within ram assembly central axial bore 42 and has a first end 56' and a second end 56". As shown in FIG. 2 and FIG. 4, tooling drive shaft first end 56' is rotatably supported in ram assembly first end 20' by an angular contact type ball bearing assembly 58, which allows the transmittal of axial thrust forces from ram assembly 20 to a cam mounting block 60 mounted on tooling drive shaft first end 56', in a first embodiment, or to a pivot base 220, in a second embodiment. Inner race **58*a* of ball bearing assembly 58 is covered by bearing cap 59 (as shown in FIGS. 5 and 6) and rests against a spacer 62 which separates inner bearing race 58*a* from an annular shoulder 61 on the cam mounting block 60, or from one side of a disk-shaped portion 220*c* of pivot base 220**.

Tooling drive shaft second end 56" is supported in tooling ram assembly 20 by a self-aligning type ball bearing assembly 70—as shown in FIG. 2. Self-aligning ball bearing assembly 70 is separated from a shoulder 72 in ram assembly 20 by "Belleville" washers 74. Self-aligning ball bearing assembly 70 compensates for any minor misalignments between tooling drive shaft 56 and tooling ram assembly 20 and applies pre-load force to bearing 70.

Figure 9:
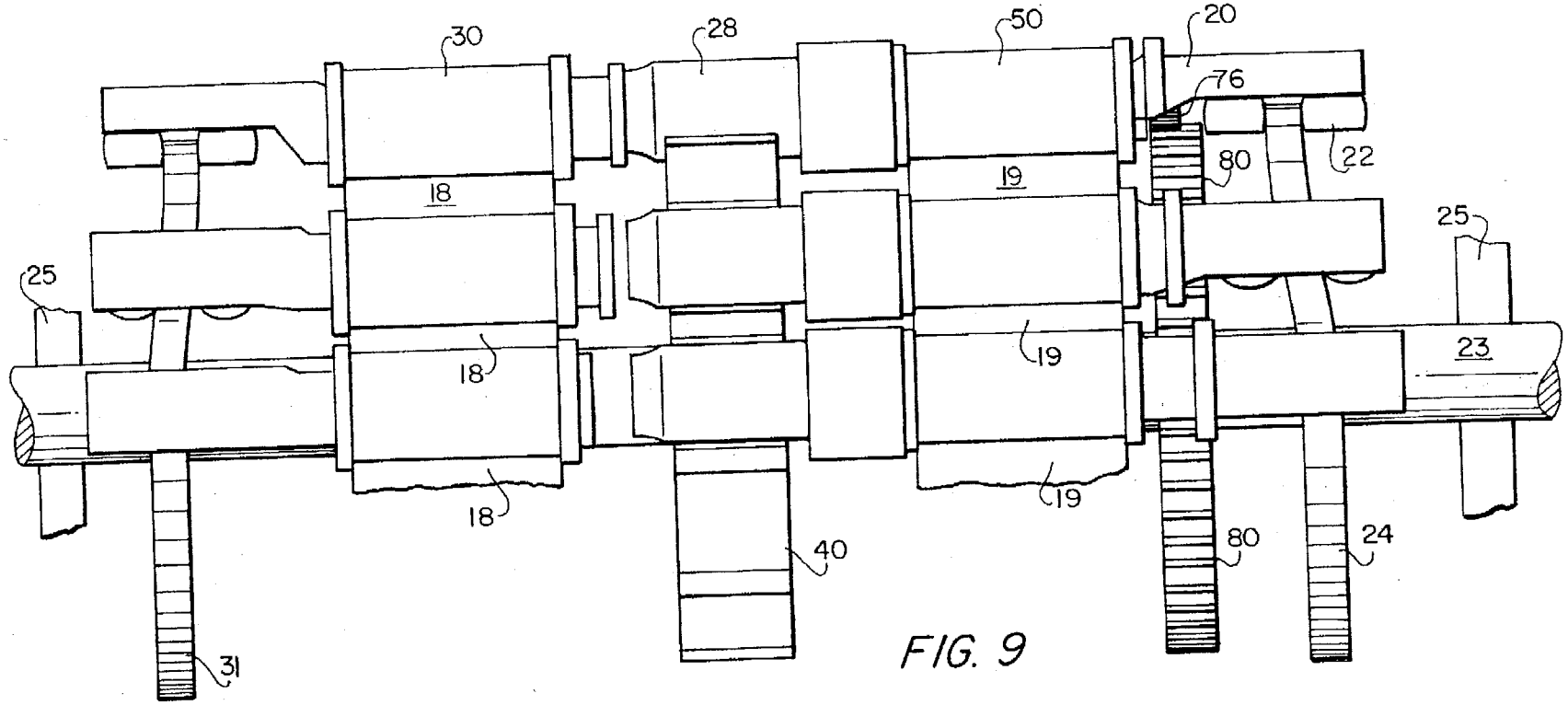
FIG. 9 is a partial front elevation view taken in the direction of arrows 9—9 in FIG. 8.

As shown in FIG. 2, a pinion drive gear 76 is keyed to tooling drive shaft second end 56". Pinion drive gear 76 is held on tooling drive shaft second end 56" by a bearing lock nut 78. Pinion drive gear 76, along with each of the pinion drive gears provided on the other tooling ram assemblies of a single turret on which assembly 20 is mounted, is engaged with a single large central bull gear 80 fixedly attached to the main frame of the apparatus (FIG. 9). Tooling drive shaft 56 is rotated by the orbital rotation of pinion drive gear 76 around fixedly positioned bull gear 80 which is fixedly attached to and supported by the frame of the apparatus. Such rotation of drive shaft 56 consequently rotates cam mounting block 60, or pivot base 220.

Figure 7:
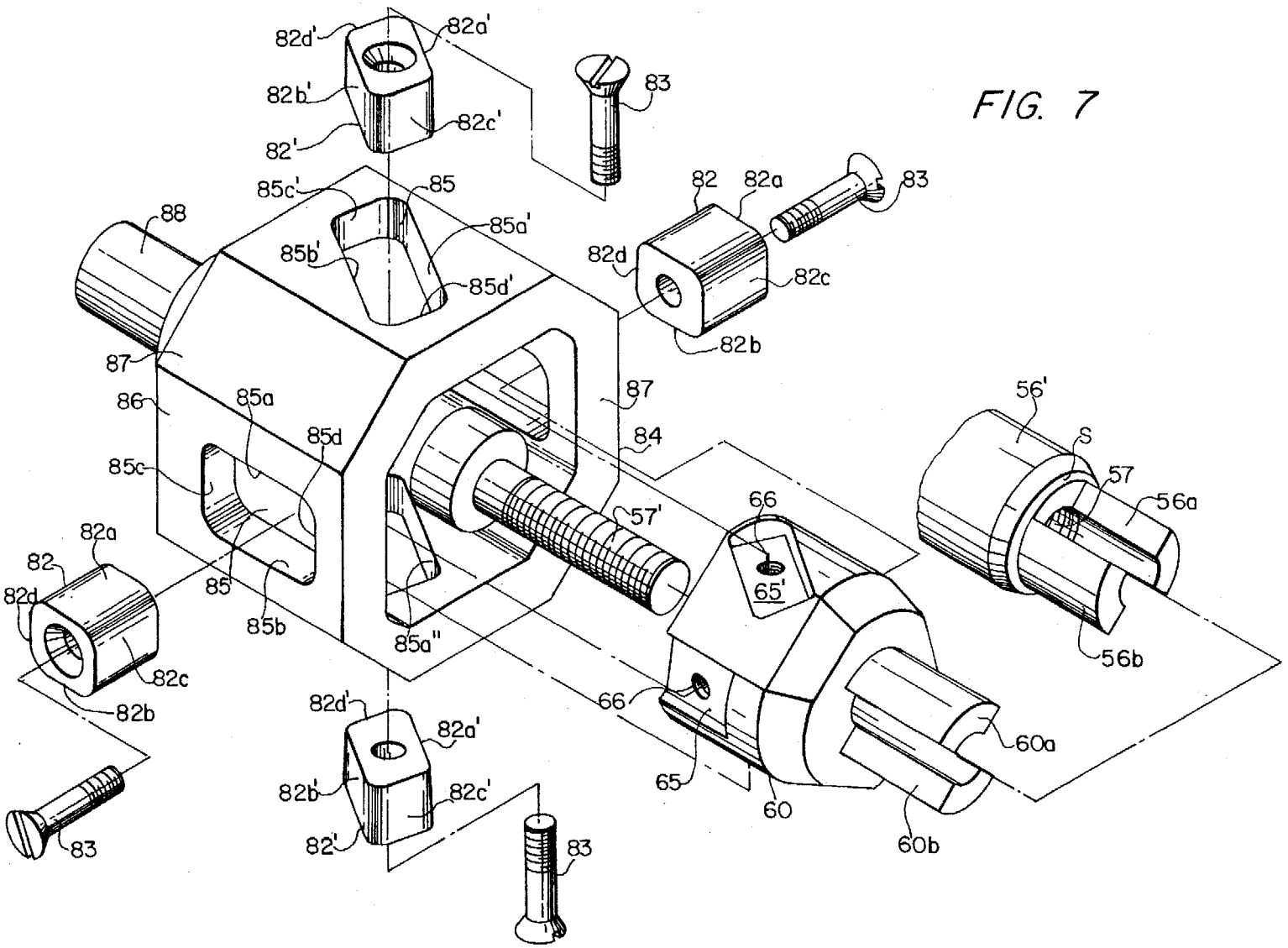
FIG. 7 is an exploded perspective view of the working assembly according to a first embodiment of the invention.
Figure 8:
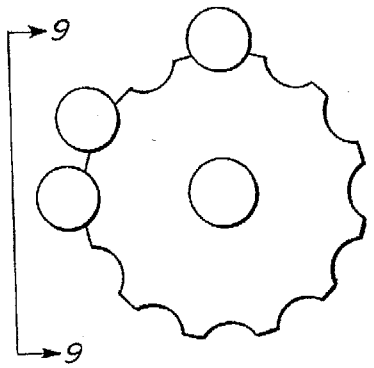
FIG. 8 is a partial end view taken through the starwheel and showing three of the tooling rams circumferentially spaced in a single tool turret.

As shown in FIG. 7, tooling drive shaft first end 56' has two circumferentially spaced, axially extending tangs **56*a* and 56*b*. These tangs are spaced 180° apart from each other and extend axially from an annular shoulder S at the tooling drive shaft first end 56'. A blind bore 57 extends axially inwardly from first end 56' of tooling drive shaft 56. Blind bore 57 is internally threaded for mating threaded engagement with a mounting screw 63 as shown in FIG. 2**.

In a first embodiment, cam mounting block 60 also has two circumferentially spaced, axially extending tangs 60*a* and 60*b* as shown. Tangs 60*a* and 60*b* are spaced 180° apart from each other and are interleaved with tangs 56*a* and 56*b* of the tooling drive shaft 56 when cam mounting block 60 is connected to tooling drive shaft 56 by screw 63 as shown in FIG. 2. The central axis of cam mounting block 60 is coincident with central axis 200 of tooling drive shaft 56. Cam mounting block screw 63 is seated in an axially extending counterbore 64 (FIG. 2) of cam mounting block 60. The threaded portion of screw 63 engages with internally threaded blind bore 57 of tooling drive shaft 56.

The remaining portion of cam mounting block 60 that extends axially from cam mounting block tangs 60*a* and 60*b*, is substantially cylindrical in shape with two axially parallel flat bottom recesses 65 machined into its outer periphery and spaced 180° apart from each other, as best shown in FIG. 7. Similarly, two skewed flat bottom recesses 65' are provided on opposite sides from each other between recesses 65. Two parallel guide blocks 82 are mounted in recesses 65 and two skewed positioner cams 82' are mounted in recesses 65'. Guide blocks 82 and skewed positioner cams 82' are substantially square or rectangular in cross-section and extend radially outwardly from cam mounting block 60. Guide blocks 82 fit snugly within flat bottom recesses 65 in cam mounting block 60. Similarly, skewed positioner cams 82' are snugly fitted in skewed recesses 65' in cam mounting block 60 as shown in FIG. 7. Screws 83 pass through the guide blocks 82 and positioner cams 82' along the central axis of each and are threadedly received into threaded bores 66 that pass through cam mounting block 60 from flat bottom recesses 65 and 65' into cam mounting block counterbore 64 (FIG. 2).

Guide blocks 82 each have two substantially flat slide surfaces 82*a* and 82*b* and two substantially flat end surfaces 82*c* and 82*d* on their outer periphery. Similarly, skewed positioner cams 82' have slide surfaces 82*a'* and 82*b'* and end surfaces 82*c'* and 82*d'*. Guide blocks 82 are located 180° from each other and are mounted to cam mounting block 60 with their slide surfaces 82*a* and 82*b* lying on planes parallel to central axis 200 of cam mounting block 60. The two skewed positioner cams 82' are also located 180° from each other and are positioned with their skewed guide slide surfaces 82*a'* and 82*b'* lying on planes that are skewed from central axis 200 of cam mounting block 60.

Guide blocks 82 have their centers aligned with axis 200 and project radially outwardly through guide slots 85 provided in roller mounting block wall portions 86 and 87 on opposite sides of a roller mounting block 84. Guide blocks 82 support roller mounting block 84 for radial shifting on the guide blocks 82 between an inner position shown in FIG. 5 and an outer or eccentric position shown in FIG. 6. Movement of roller mounting block 84 between its inner and outer positions is effected by the reaction of skewed cams 82' with surfaces 85*a'* and 85*b'* of slots 85'.

Roller mounting block 84 includes a roller mounting block shaft portion 88 having a central axis 201 (FIGS. 5 and 6) and a roller mounting block guide portion 86 having a central axis 202. Roller mounting block guide portion 86 is substantially octagonal in shape and roller mounting block guide slots 85 and 85' pass through four of the eight side walls 87 spaced 90° apart from each other. Guide slots 85 are substantially rectangular in shape and are each dimensioned with two opposing guide slot guiding surfaces 85*a* and 85*b* spaced apart to allow for a sliding fit with two opposing guide surfaces 82*a* and 82*b* of guide blocks 82. End surfaces 85*c* and 85*d* are provided in slots 85; similarly, end surfaces 85*c'* and 85*d'* are provided in slots 85'.

Roller mounting block shaft portion 88 is substantially cylindrical in shape and extends with its central axis 201 parallel and eccentric to central axis 202 of roller mounting block guide portion 86, as shown in FIGS. 5 and 6. Roller mounting block shaft portion 88 supports reforming roller 26 through two ball bearings 90 that are held in position on shaft portion 88 by cap screw 89 shown in FIG. 5.

A central radially extending support flange 92 of reforming roller 26 is sandwiched in between an outer roller guide 94 and an inner roller guide 96 that allow support flange 92 and reforming roller 26 to move radially, in a plane perpendicular to central axis 200 of tooling drive shaft 56, but not axially. Inner roller guide 96 and outer roller guide 94 are supported in a roller guide housing 100 that is substantially cylindrical in shape and has an outer end 101 and an inner end 102, as shown in FIGS. 5 and 6. An O-ring seal can be provided either on one of roller guides 94 or 96, as shown in FIGS. 5 and 6, or on support flange 92, as shown in FIG. 6A.

Roller guide housing inner end 102 has internal threads that are engaged with external threads on slide bushing first end 50'. A roller guide housing spacer 106, as best shown in FIGS. 5 and 6, is positioned between an annular shoulder 107 spaced axially inwardly from roller guide housing inner end 102, and slide bushing first end 50'. Roller guide housing outer end 101 provides a support surface for a container holder 104 which acts as a support for can 28. Container holder 104 is removably attached to roller guide housing 100 by container holder bolts 103 and may be interchanged with another container holder having a different shape and/or dimensions to accommodate containers having various different lower end configurations. Container holder 104 may be constructed similarly to the jig 48 shown in the ANC patent, with a bottom peripheral profile portion 105, as shown in FIG. 5, that substantially corresponds in shape to outer annular wall 34 of container 28.

Figure 6A:
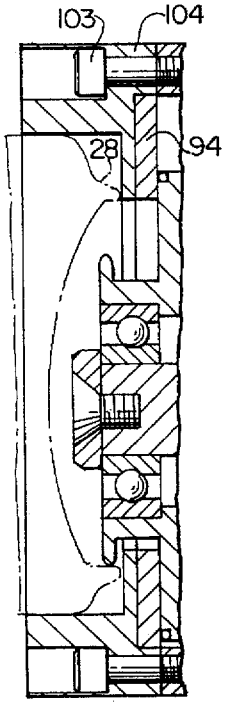
FIG. 6A is a cross-sectional view showing an embodiment of the container holder located at the end of the tooling ram.
Figure 6:
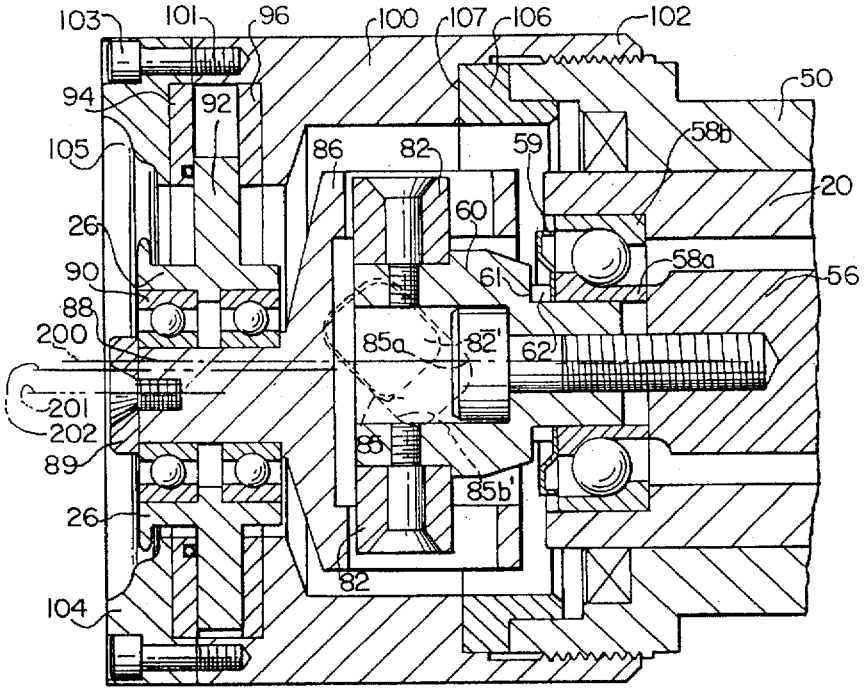
FIG. 6 is a cross-sectional view showing the reforming roller in its fully extended position.

However, in another embodiment of the container holder, as shown in FIG. 6A, container holder 204 is manufactured so as to accommodate and support a variety of containers 28 having the same outer diameter of cylindrical side wall 33, but having outer annular wall 34 of varying profile. Container holder 204 also clamps annular outer roller guide 94, reforming roller support flange 92 and annular inner roller guide 96 against roller guide housing outer end 101, thereby ensuring the precise axial position of reforming roller 26 relative to can 28 supported on bottom peripheral profile surface 105.

Outer roller guide 94 and inner roller guide 96 along with roller guide housing 100 and slide bushing 50 ensure that travel of reforming roller 26 will be limited to a single plane perpendicular to central axis 201 of roller mounting block shaft portion 88. Because central axis 201 of roller mounting block shaft portion 88 is parallel and eccentric to central axis 202 of roller mounting block guide portion 86, rotation of roller mounting block guide portion 86 results in reforming roller 26 orbiting central axis 202 of roller mounting guide portion 86.

Roller mounting block guide portion 86 is rotated by the rotation of cam mounting block 60 which is engaged with tooling drive shaft 56 through tangs 60*a*, 60*b*, 56*a*, and 56*b*. Rotation of cam mounting block 60 transmits a rotational force through guide blocks 82 and skewed positioner cams 82' to roller mounting block 84.

After a can 28 has been brought into position for processing, and is held in position on bottom peripheral profile surface 105, cam mounting block 60 is moved axially to the left as viewed in FIG. 5 along axis 200 towards can 28 by the cooperation of cam followers 22 with stationary cam 24. Tool drive ram assembly 20 transmits this axial movement to cam mounting block 60 through angular contact ball bearing assembly 58 and cam mounting block spacer 62.

Tooling drive shaft 56, and therefore cam mounting block 60, is continuously rotated by pinion drive gear 76, which is always meshed with large fixed central bull gear 80 (shown in FIG. 9). Therefore, reforming roller 26 continues to traverse a closed path and orbit the axis 200 of tooling drive shaft 56 even as the diameter of its closed path is varied from its retracted position of FIG. 5 to its extended position of FIG. 6 as a result of the axial movement of tool drive ram assembly 20.

As tool drive ram assembly 20, and therefore cam mounting block 60 is moved axially toward can 28 (toward the fully extended position shown in FIG. 6), skewed positioner cams 82' react against surfaces **85*b*' to force roller mounting block 84 to move in a radial direction (downward as viewed in FIG. 5) on parallel guide blocks 82 as skewed guide slide surfaces 82*b*' of cams 82' slide along mating skewed guide slot guiding surfaces 85*b*' until movement of cam mounting block 60 to the left (as in FIG. 5) is terminated. With tool drive ram assembly 20 in a fully extended (leftward) position (as shown in FIG. 6) roller mounting block shaft portion 88, and therefore reforming roller 26 is moved to its most eccentric position relative to the central axis 200 of tooling drive shaft 56, and reforming roller 26 orbits about a closed path with the largest possible diameter. As reforming roller 26 approaches this position it follows a substantially spiral path. Reforming roller 26 contacts annular, substantially longitudinal wall 38 on can 28 (shown in FIGS. 10–12**) and completes the inside can base reforming operation while in the outermost position defined by the termination of its spiral path.

The radial retraction of reforming roller 26 from its most eccentric position shown in FIG. 6 is effected by the rightward axial retraction of tool drive ram assembly 20 along with cam mounting block 60. Parallel surfaces **82*a* and 82*b* of guide blocks 82 slidingly engage surfaces 85*a* and 85*b* within roller mounting block parallel guide slots 85 and transmit rotational force to roller mounting block 84, but do not provide any of the force in a radial direction for moving reforming roller 26. The radially inward and outward force on reforming roller 26 is created by the skewed guide cam slide surfaces 82*a*' and 82*b*' reacting with skewed surfaces 85*a*' and 85*b*' which converts the axial thrust from cam mounting block 60 into a radial force on roller mounting block 84. The radial movement of mounting block 84 results in the reforming roller 26 following a spiral path as it moves into contact with can 28** and again when retracting from the can.

Retraction of roller 26 from its most eccentric FIG. 6 position begins with movement of cam follower 22 to the right which moves mounting block 60 to the right and causes surfaces **82*a*' of skewed positioner cams 82' to react with surfaces 85*a*' of slots 85' so that shaft 88 is moved radially inward. The provision of skewed positioner cams 82' as well as parallel guide blocks 82 on a single cam mounting block 60, allows for a single actuating means for driving reforming roller 26 along an arcuate path to traverse wall 38 of can 28 and for actuating reforming roller 26 in a radial direction to bring roller 26 into contact with wall 38** and retract it therefrom.

Figure 13:
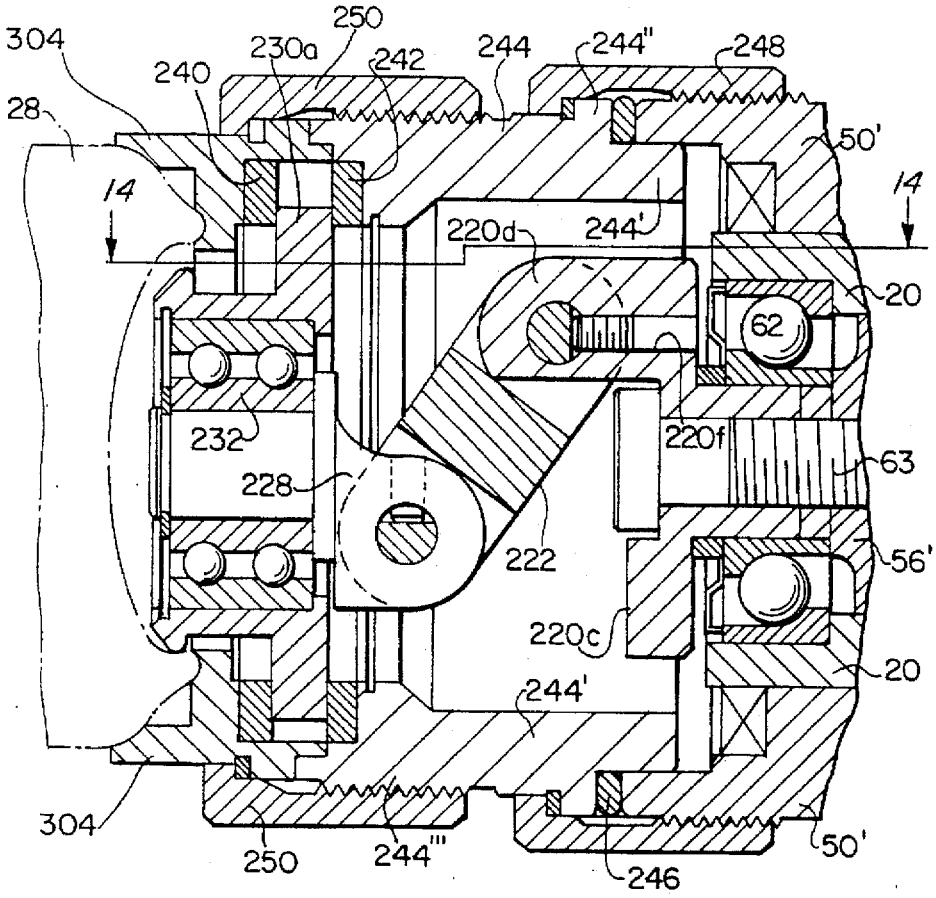
FIG. 13 is a vertical longitudinal cross-sectional view of one end of a tooling drive ram assembly according to an embodiment of the invention, showing a single actuating means in the form of a pivot arm for driving the reforming roller.
Figure 14:
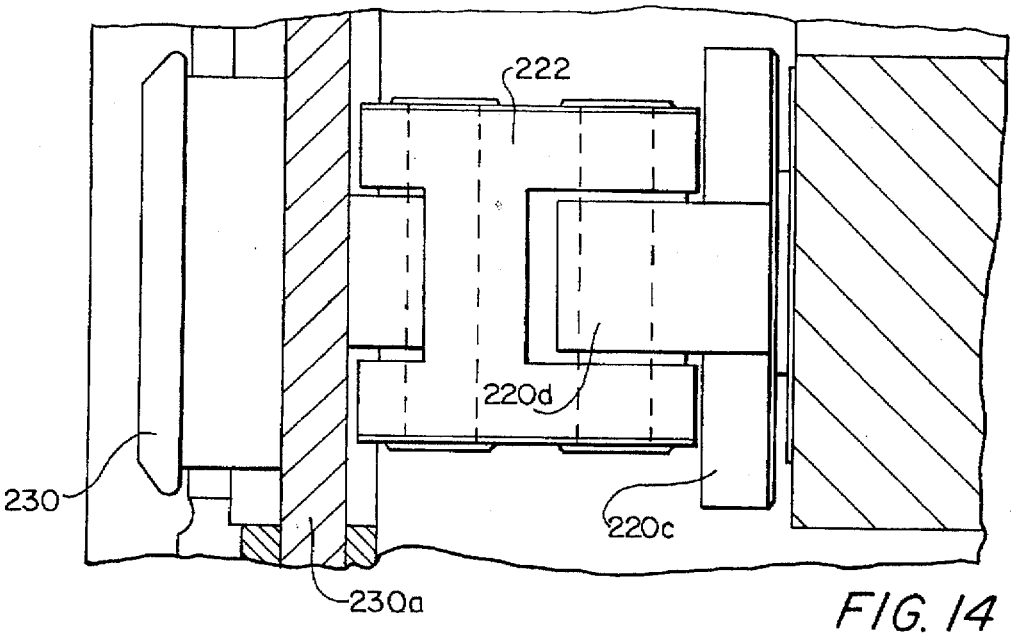
FIG. 14 is a top plan view taken in the direction of arrows 14—14 in FIG. 13.
Figure 15:
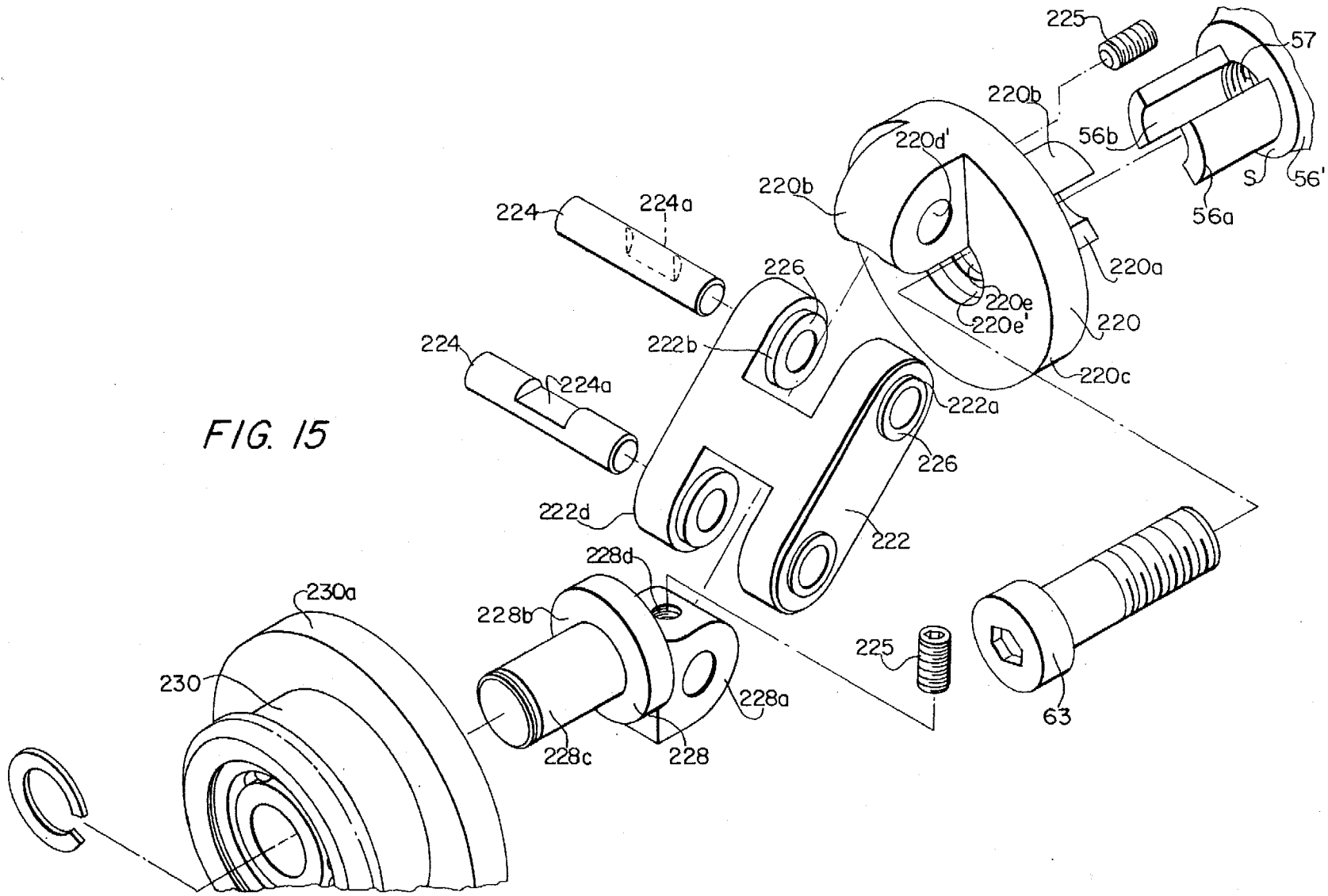
FIG. 15 is an exploded perspective view of a working assembly according to a preferred embodiment of the invention.

In a second, preferred embodiment of the present invention, the single actuating means for driving the reforming roller along an arcuate path to traverse substantially longitudinal wall 38 of can 28 and for actuating the reforming roller in a radial direction to bring the roller into contact with wall 38 and retract it therefrom, comprises a simplified toggle-type mechanism, as shown in FIGS. 13–15. In this preferred embodiment, first end 56' of tooling drive shaft 56 is connected to a pivot base 220 in a similar fashion to the connection with cam mounting block 60, described above. The central axis of pivot base 220 coincides with central axis 200 of the tooling ram assembly. Axially extending tangs **220*a* and 220*b* are formed from two circumferentially spaced, 90 degree segments of a ring, with the centers of tangs 220*a* and 220*b* being spaced 180 degrees apart from each other so that tangs 220*a* and 220*b* can be interleaved with tangs 56*a* and 56*b* of tooling drive shaft 56**.

Pivot base 220 is constructed with tangs **220*a* and 220*b* extending in a first axial direction from the center of one side of a disk-shaped portion 220*c*. An offset lug 220*d* extends in the opposite axial direction from the other side of disk-shaped portion 220*c*, as best seen in FIG. 15**.

A central axial bore **220*e* passes through disk-shaped portion 220*c* and in between tangs 220*a* and 220*b*, and has a counterbore 220*e*' extending in from the same side of disk-shaped portion 220*c* as lug 220*d*, such that a bolt 63 can be passed through pivot base 220 and seated in counterbore 220*e*' in order to fixedly attach pivot base 220 to tooling drive shaft 56. Lug 220*d* protrudes from the side of disk-shaped portion 220*c* opposite tooling drive shaft 56, and is offset from the central axis of pivot base 220 such that as pivot base 220 is rotated, lug 220*d* orbits the central axis of pivot base 220. Lug 220*d* is provided with a through pin hole 220*d*' having a central axis offset from and perpendicular to the central axis of pivot base 220**.

An H-shaped pivot arm 222 is pinned to pivot base 220 at lug **220*d* by a pivot pin 224 that passes through two legs of pivot arm 222 on a first axial end of pivot arm 222, and through pin hole 220*d*'. Pivot pin 224 is rotatably seated in cylindrical bushings 226 that are pressed into axially aligned holes 222*a* and 222*b* at the first axial end of pivot arm 222. Pivot pin 224 has a central notch 224*a* cut into its outer diameter in order to create a flat surface against which a set screw 225 can be seated to lock pivot pin 224 in place relative to lug 220*d*. Set screw 225 is threaded into a hole 220*f* having a central axis parallel to the central axis of pivot base 220 and passing through disk-shaped portion 220*c* and lug 220*d* into pin hole 220*d*'. Hence, pivot arm 222 has a single degree of rotational freedom, about pivot pin 224, relative to pivot base 220**.

The second axial end of pivot arm 222 is similarly pinned to a pivot roller shaft 228. Pivot roller shaft 228 has a lug **228*a* that is offset from the central axis of pivot roller shaft 228. Lug 228*a* extends from one axial side of a central disk-shaped portion 228*b*, and a roller mounting shaft 228*c* extends from the opposite axial side of disk-shaped portion 228*b*. Pivot pin 224 extends through bushings 226 that are pressed into axially aligned pin holes 222*c* and 222*d* at the second axial end of pivot arm 222. Pivot pin 224 is locked in place relative to pivot roller shaft 228 by a set screw 225. Set screw 225 passes through a hole in lug 228*a* and is oriented with its axis perpendicular to the central axis of pivot roller shaft 228**.

Roller mounting shaft **228*c* of pivot roller shaft 228 rotatably supports reforming roller 230 on a roller bearing 232 that is press fit into a central axial bore through reforming roller 230. Reforming roller 230 is supported in like manner to reforming roller 26 of the first embodiment of the present invention, with a radially extending support flange 230***a* being sandwiched in between a disk-shaped outer roller guide 240 and a disk-shaped inner roller guide 242.

A substantially cylindrical tooling holder 244 is mounted to the slide bushing first end 50', as shown in FIG. 13. Slide bushing first end 50' fits over tooling holder first end 244' and abuts against a radially extending flange 244". An annular spacer 246 of predetermined dimensions can be placed between tooling holder first end 244' and radially extending flange 244", as shown in FIG. 13, in order to adjust the axial spacing of tooling holder 244 relative to tool drive ram assembly 20. Inner roller guide 242 is supported in a counterbore that is provided in from the second end 244'" of tooling holder 244. Tooling holder 244 is connected to slide bushing first end 50' by a locking ring 248 that engages with radially extending flange 244" and is internally threaded to meshingly engage with external threads on slide bushing first end 50'.

Figure 16:
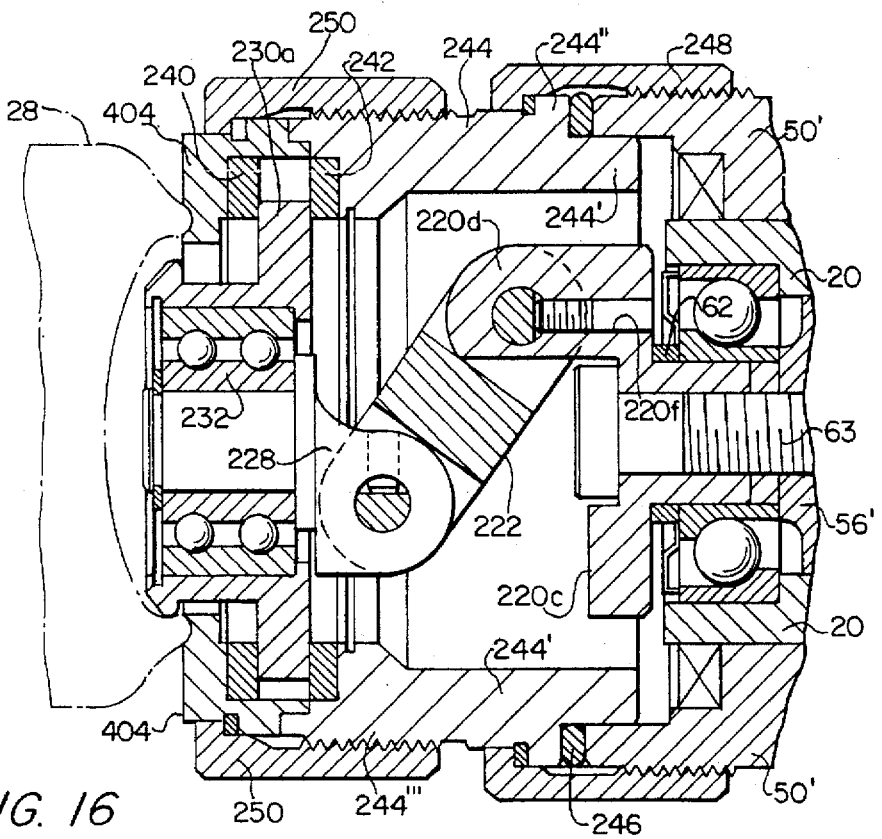
FIG. 16 is vertical longitudinal cross-sectional view of one end of a tooling drive ram assembly according to a preferred embodiment of the invention, showing the preferred can holder supporting the can only along the convex U-shaped ridge at the bottom of the can.
Figure 17:
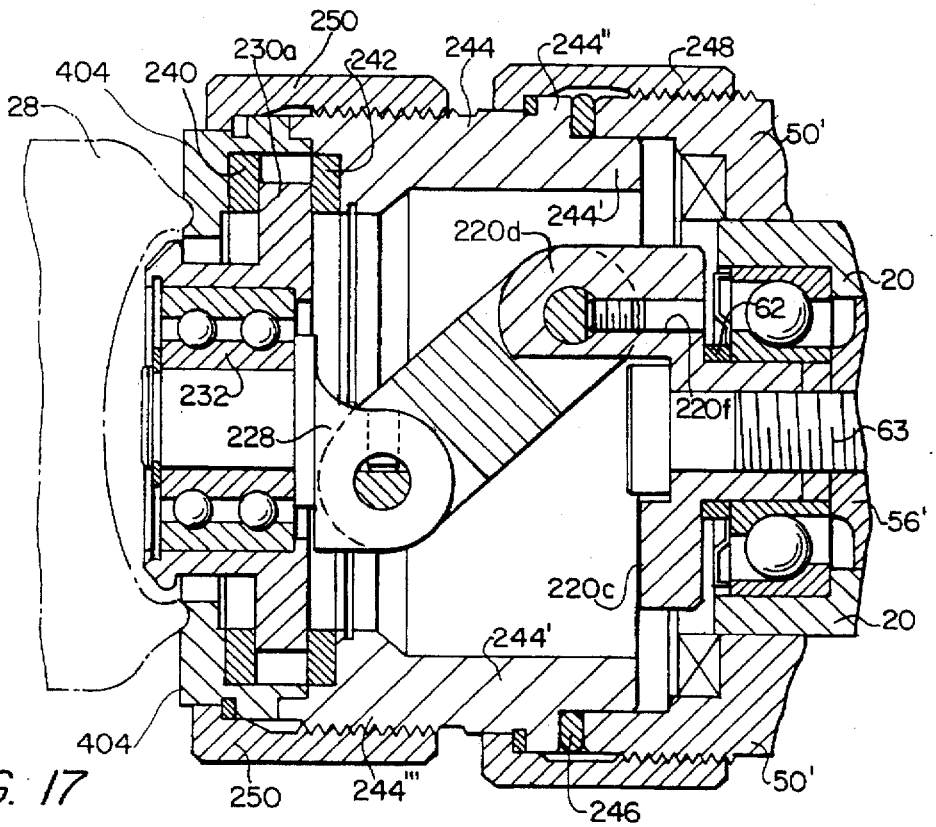
FIG. 17 is a cross sectional view of the preferred embodiment shown in FIG. 16, with the tool drive ram assembly retracted to the right in the figure and the reforming roller out of contact with the can.

Outer roller guide 240 is supported in axially spaced relationship with inner roller guide 242 by a can holder 304, shown in FIG. 13, or can holder 404, shown in FIGS. 16 and 17. A second locking ring 250 connects either can holder 304 or 404 to tooling holder second end 244'". Outer roller guide 240 sits in a counterbore machined in from the axial end of either can holder 304 or can holder 404 opposite the axial end of the can holder that is provided with contoured surfaces to mate with portions of the bottom end of a can. The proper positioning of reforming roller 230 relative to a can 28 is assured by machining either can holder 304 or 404 with the counterbore for outer roller guide 240 spaced axially at the proper distance from the contoured surfaces for supporting can 28.

In the embodiment shown in FIG. 13, can holder 304 supports can 28 along part of the annular arcuate portion 34 joining the cylindrical side wall 33 of can 28 to the outer periphery of convex U-shaped portion 35, and along the bottommost edge of the can. However, the can holder does not contact the can in an annular region of the outer periphery of the convex, U-shaped portion that is in radial alignment with the arcuate path traveled by the reforming roller on substantially longitudinal wall 38 connected to the inner periphery of convex U-shaped portion 35.

In the preferred embodiment shown in FIGS. 16 and 17, can holder 404 supports can 28 only along an annular arcuate portion of the convex U-shaped ridge 35. As clearly seen in FIGS. 16 and 17, can 28 remains entirely unsupported along cylindrical side wall 33 and along annular arcuate portion 34. Can holder 404 can be used to support cans having a large variety of lower end configurations, as long as the diameter of the convex U-shaped ridge 35 of the cans is approximately the same as the diameter of the annular concave groove machined into the axial end surface of can holder 404.

Inner and outer roller guides 242 and 240, can holder 304, can holder 404, and tooling holder 244 ensure that reforming roller 230 can not be moved axially relative to slide bushing 50 and radial supports 18 and 19. Therefore, as tool drive ram assembly 20 is driven axially by the interaction of cam followers 22 with cam 24, pivot base 220 is moved axially, forcing pivot arm 222 to drive pivot roller shaft 228, and hence reforming roller 230, radially outward. Simultaneous rotation of tooling drive shaft 56 causes pivot base lug 220*d* to orbit central axis 200 and hence rotate pivot arm 222 such that reforming roller 230 travels in a spiraling outward path as tool drive ram assembly 20 is driven to the left in FIG. 13.

Therefore, pivot arm 222 provides a single actuating means for driving reforming roller 230 to orbit longitudinal axis 200, while moving reforming roller 230 in a radially outward direction relative to axis 200, thereby bringing reforming roller 230 gradually into contact with substantially longitudinal wall 38 of can 28 while traversing and reforming wall 38. Pivot base 220 and tooling drive shaft 56 provide means for moving pivot arm 222 in a direction along axis 200 and means for rotating pivot arm 222 about axis 200.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

LIST OF DESIGNATORS

S annular shoulder
18 support
19 support
20 tool drive ram assembly
20' ram assembly first end
20" ram assembly second end
21 outer peripheral surface of 20'
22 cam followers
23 main shaft
24 fixed cam
25 main frame
26 reforming roller
28 can
30 can push ram
31 fixed cam
33 can side wall
34 can outer annular wall
35 can convex U-shaped portion
36 can preformed bottom wall
37 can center domed portion
38 can annular substantially vertical wall
40 vacuum starwheel
42 took drive ram assembly central axial bore
44 ram assembly intermediate connecting portion
46 cam follower retainer nuts
48 slide bushing axial bore
50 slide bushing
50' slide bushing first end
50" slide bushing second end
52 grease fitting
54 oil seals
56 tooling drive shaft
56' tooling drive shaft first end
56" tooling drive shaft second end
56*a* and 56*b* tooling drive shaft tangs
57 tooling drive shaft blind bore
58 ball bearing assembly
58*a* inner race of ball bearing assembly
58*b* outer race of ball bearing assembly
59 bearing cap
60 cam mounting block
60*a* and 60*b* cam mounting block tangs
61 cam mounting block shoulder
62 cam mounting block spacer
63 cam mounting block screw
64 cam mounting block counterbore

65 guide cam recess
65' skewed recesses
66 cam mounting block threaded bores
70 self-aligning ball bearing assembly
72 ram assembly shoulder
74 Belleville Washers
76 pinion drive gear
78 bearing lock nut
80 bull gear
82 parallel guide blocks
**82*a* and 82*b*** parallel guide slide surfaces
**82*c* and 82*d*** parallel guide cam end surfaces
82' skewed positioner cams
**82*a*' and 82*b*'** skewed guide slide surfaces
**82*c*' and 82*d*'** skewed guide end surfaces
83 guide cam screw
84 roller mounting block
85 roller mounting block parallel guide slot
**85*a*' and 85*b*'** parallel guide slot guiding surfaces
**85*c* and 85*d*** parallel guide slot end surfaces
85' roller mounting block skewed guide slot
**85*a*" and 85*b*"** skewed guide slot guiding surfaces
**85*c*' and 85*d*'** skewed guide slot stop surfaces
86 roller mounting block guide portion
87 guide portion side wall
88 roller mounting block shaft portion
89 roller mounting block cap screw
90 roller mounting block ball bearings
92 reforming roller central support flange
94 outer roller guide
95 O-ring seal
96 inner roller guide
100 roller guide housing
101 roller guide housing outer end
102 roller guide housing inner end
103 container holder bolts
104 container holder
105 bottom peripheral profile surface
106 roller guide housing spacer
107 roller guide housing annular shoulder
200 central axis of tooling ram assembly
201 central axis of roller mounting block shaft portion
202 central axis of roller mounting block guide portion
204 can holder
220 pivot base
**220*a* and 220*b*** tangs
**220*c*** disk-shaped portion
**220*d*** lug
**220*d'*** pin hole
**220*e*** central bore
**220*e'*** counterbore
**220*f*** set screw bore
222 pivot arm
**222*a*, 222*b*, 222*c* and 222*d*** pin holes
224 pivot pin
**224*a*** notch
225 set screw
226 bushing
228 pivot roller shaft
**228*a*** lug
**228*b*** disk-shaped portion
**228*c*** roller mounting shaft
**228*d*** set screw bore
230 reforming roller
**230*a*** radially extending support flange
232 roller bearing
240 outer roller guide
242 inner roller guide
244 tooling holder
244' first end tooling holder
244" radially extending flange
244'" second end tooling holder
246 spacer
248 locking ring
250 locking ring
304 can holder
304 can holder

What is claimed is:

1. An apparatus for reforming the base of a cylindrical container having a longitudinal axis, and a substantially vertical wall concentric with said longitudinal axis and extending from the base of the container joining a center domed portion of the base to an annular flange-like ridge on the base, said apparatus comprising:

means for supporting said container;

a reforming roller;

a single actuating means for driving said reforming roller to orbit said longitudinal axis, while moving said roller in a radially outward direction relative to said longitudinal axis, thereby bringing said roller gradually into contact with said substantially vertical wall of said container while traversing and reforming said substantially vertical wall;

means for moving said single actuating means in a direction along an axis coinciding with said longitudinal axis and for rotating said single actuating means about said axis;

said means for supporting said container comprising an annular member that contacts and supports said base of said container only along said annular arcuate portion of the annular flange-like ridge of the base of the container.

2. A method of reforming the base of a container with a reforming roller, wherein the container has a longitudinal axis, an outer periphery and a substantially longitudinal wall concentric with said longitudinal axis and joining a center domed portion of the base to an annular flange-like ridge on the base, the method including the steps of:

supporting said container base solely along said annular arcuate portion of said annular flange-like ridge;

moving an actuating means along an axis coinciding with said longitudinal axis of said container;

rotating said actuating means about said axis; and moving said reforming roller with said actuating means in a radially outward direction relative to said longitudinal axis, thereby bringing said reforming roller gradually into contact with said substantially longitudinal wall of said container while traversing and reforming said substantially longitudinal wall.

* * * * *